US009695691B2

(12) United States Patent
Shimaguchi et al.

(10) Patent No.: US 9,695,691 B2
(45) Date of Patent: Jul. 4, 2017

(54) GAS COMPRESSOR

(71) Applicant: CALSONIC KANSEI CORPORATION, Saitama (JP)

(72) Inventors: Hirotada Shimaguchi, Saitama (JP); Masahiro Tsuda, Saitama (JP); Kouji Hirono, Saitama (JP); Tatsuya Osaki, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 16 days.

(21) Appl. No.: 14/405,260

(22) PCT Filed: Jul. 1, 2013

(86) PCT No.: PCT/JP2013/068042

§ 371 (c)(1),
(2) Date: Dec. 3, 2014

(87) PCT Pub. No.: WO2014/030436

PCT Pub. Date: Feb. 27, 2014

(65) Prior Publication Data

US 2015/0147216 A1 May 28, 2015

(30) Foreign Application Priority Data

Aug. 22, 2012 (JP) ..... 2012-183394
May 30, 2013 (JP) ..... 2013-113742

(51) Int. Cl.
*F04C 2/344* (2006.01)
*F01C 1/356* (2006.01)
(Continued)

(52) U.S. Cl.
CPC ..... *F01C 21/10* (2013.01); *F01C 21/106* (2013.01); *F04C 18/3441* (2013.01);
(Continued)

(58) Field of Classification Search
CPC .... F04C 18/3441; F04C 29/12; F04C 29/126; F01C 21/0809
(Continued)

(56) References Cited

U.S. PATENT DOCUMENTS 3,385,513 A * 5/1968 Kilgore ..... F04C 29/026 418/147
3,865,515 A * 2/1975 Allen ..... F01C 21/10 417/283
(Continued)

FOREIGN PATENT DOCUMENTS

EP 2 784 325 10/2014
EP 2 851 568 3/2015
(Continued)

OTHER PUBLICATIONS

International Search Report (ISR) issued Sep. 10, 2013 in International (PCT) Application No. PCT/JP2013/068042.
(Continued)

*Primary Examiner* — Deming Wan
(74) *Attorney, Agent, or Firm* — Wenderoth, Lind & Ponack, L.L.P.

(57) ABSTRACT

A compressor body is formed such that a compression chamber is divided by a rotor, a cylinder, side blocks and vanes, a housing which covers the compressor body is included, and an outline shape of a cross section of an inner circumferential surface of the cylinder is formed such that, in a period of one rotation of the rotor, (i) a region in which a capacity of the compression chamber increases, (ii) a region in which the capacity of the compression chamber reduces, (iii) a region in which a capacity reduction rate of the compression chamber is smaller than a capacity reduction rate of the region (ii), and (iv) a region in which the capacity reduction rate of the compression chamber is larger
(Continued)

than a capacity reduction rate of the region (iii) are consecutively provided in order.

14 Claims, 7 Drawing Sheets

(51) Int. Cl.

| | |
|---|---|
| ***F04C 18/344*** | (2006.01) |
| ***F01C 21/18*** | (2006.01) |
| ***F04C 15/06*** | (2006.01) |
| ***F01C 21/10*** | (2006.01) |
| *F04C 29/12* | (2006.01) |
| *F01C 21/08* | (2006.01) |

(52) U.S. Cl.
CPC ..... *F01C 21/0809* (2013.01); *F01C 21/0863* (2013.01); *F04C 29/12* (2013.01); *F04C 29/128* (2013.01); *F04C 2250/30* (2013.01)

(58) Field of Classification Search
USPC ..... 418/236–238, 83, 259, 15, 270, DIG. 1; 417/284
See application file for complete search history.

(56) References Cited

U.S. PATENT DOCUMENTS

| | | | |
|---|---|---|---|
| 4,299,097 | A | 11/1981 | Shank et al. |
| 4,480,973 | A | 11/1984 | Ishizuka |

FOREIGN PATENT DOCUMENTS

| | | |
|---|---|---|
| EP | 2 889 486 | 7/2015 |
| JP | 51-2015 | 1/1976 |
| JP | 54-81113 | 11/1977 |
| JP | 54-28008 | 3/1979 |
| JP | 56-54986 | 5/1981 |
| JP | 56-150886 | 11/1981 |
| JP | 62-247195 | 10/1987 |
| JP | 1-18867 | 6/1989 |
| JP | 2003-155985 | 5/2003 |
| JP | 2004-27920 | 1/2004 |

OTHER PUBLICATIONS

Extended European Search Report issued Sep. 24, 2015 in corresponding European Patent Application No. 13831133.7.

* cited by examiner

GAS COMPRESSOR

CROSS-REFERENCE TO RELATED APPLICATIONS

The present application is based on and claims priority from Japanese Patent Application Number 2012-183394, filed Aug. 22, 2012, and Japanese Patent Application Number 2013-113742, filed May 30, 2013, the disclosures of which are hereby incorporated by reference herein in their entirety.

BACKGROUND OF THE INVENTION

1. Field of the Invention

The present invention relates to a gas compressor, and in particular, relates to improvement of a discharge efficiency in a rotary vane type gas compressor.

2. Description of Related Art

In an air conditioning system, a gas compressor is used which compresses gas such as a refrigerant gas, or the like, and circulates the gas in the air conditioning system.

In the gas compressor, a compressor body, which is rotationally driven and compresses gas, is stored in a housing, and in the housing, a discharge chamber to which a high-pressure gas from the compressor body is discharged is formed to be divided by the housing and the compressor body, and the high-pressure gas is discharged outside of the housing from the discharge chamber.

As an example of such a gas compressor, a so-called rotary vane type compressor is known.

In the rotary vane type gas compressor, a compressor body is stored in a housing. The compressor body includes a rotor, a cylinder, a plurality of plate-like vanes, and side blocks. The rotor has an approximately cylindrical shape, and rotates integrally with a rotary shaft. The cylinder has an inner circumferential surface having an outline shape surrounding the rotor from the outside of a circumferential surface of the rotor. The plate-like vanes are stored in vane grooves formed in the rotor, and provided to freely protrude outward from the circumferential surface of the rotor. In each of the side blocks, a shaft bearing is formed which supports the rotary shaft protruding from each end surface of the rotor to rotate freely, and each side block contacts and covers an end surface of each of the rotor and the cylinder. In the compressor body, a cylinder chamber, which is a space where intake, compression and discharge of gas are performed, is formed by an outer circumferential surface of the rotor, the inner circumferential surface of the cylinder, and an inner surface of each of the side blocks.

An end on a protrusion side of each vane protruding from the circumferential surface of the rotor contacts the inner circumferential surface of the cylinder, and therefore, the cylinder chamber is divided into a plurality of compression chambers by the outer circumferential surface of the rotor, the inner circumferential surface of the cylinder, the inner surface of each of the side blocks, and surfaces of two vanes consecutively provided along a rotational direction of the rotor.

Then, a high-pressure gas compressed in a compression chamber is discharged to the outside of the compressor body through a discharge part formed in the cylinder (Japanese Patent Application Publication Number S54-28008).

Problem to be Solved by the Invention

Incidentally, in a compressor body of a gas compressor disclosed in Japanese Patent Application Publication Number S54-28008, an outline shape of a cross section of an inner circumferential surface of a cylinder is formed to be an approximately true circle, and a rotation center of an outer circumferential surface of a rotor is placed so as to deviate from a center of the inner circumferential surface of the cylinder with eccentricity, and therefore, compression chambers which change a capacity inside the compression chambers are formed. However, in a case where the outline shape of the cross section of the inner circumferential surface of the cylinder is thus the approximately true circle, a period in which a capacity of a compression chamber increases and a period in which the capacity of the compression chamber reduces become approximately half-and-half of a period of one rotation of the rotor.

In the case of the above prior art, where a period occupied by a compression process or a discharge process in which the capacity of the compression chamber reduces is comparatively short with respect to an entire period, overcompression occurs due to a rapid compression, a discharge pressure drop increases due to a fast discharge flow velocity, and the like, which lead to increasing motive power, and it is not possible to improve efficiency (a coefficient of performance, or COP: refrigerated air conditioning performance/power).

SUMMARY OF THE INVENTION

Considering the above-mentioned circumstances, an object of the present invention is to provide a gas compressor which improves efficiency.

Means for Solving the Problem

In a gas compressor according to the present invention, an outline shape of a cross section of an inner circumferential surface of a cylinder is formed such that, in a period of one rotation of a rotor, the following regions (1) to (4) are consecutively provided in order of the regions (1) to (4), and therefore, a compression process and a discharge process (processes corresponding to the regions (2) to (4)) are formed so as to be lengthened with respect to an intake process (a process corresponding to the region (1)), and furthermore, by reducing a capacity reduction rate in the late compression process, an occurrence of overcompression due to a rapid compression is prevented, and by slowing a discharge flow velocity, a discharge pressure drop is reduced, and an increase in the motive power is prevented. Regions (1) to (4) are as follows:

(1) a region in which a capacity of a compression chamber rapidly increases;

(2) a region in which the capacity of the compression chamber rapidly reduces;

(3) a region in which a capacity reduction rate of the compression chamber becomes smaller than a capacity reduction rate of the region (2); and (4) a region in which the capacity reduction rate of the compression chamber becomes larger than a capacity reduction rate of the region (3).

That is, a gas compressor according to the present invention includes a compressor body and a housing which covers the compressor body, and the compressor body has an approximately cylindrical-shaped rotor which rotates around a shaft, a cylinder which has an inner circumferential surface having an outline shape surrounding the rotor from the outside of an outer circumferential surface of the rotor, a plurality of plate-like vanes which receive a back pressure from vane grooves formed in the rotor and freely protrude outward from the rotor, and two side blocks which are located on both end surface sides of the rotor and the cylinder, and in the compressor body, a plurality of compression chambers divided by the rotor, the cylinder, the side blocks and the vanes are formed, and each compression chamber is formed such that only one cycle of intake, compression and discharge through a discharge part formed in the cylinder of gas is performed in a period of one rotation of the rotor, and the outline shape of the cross section of the inner circumferential surface of the cylinder is formed such that the regions (1) to (4) are consecutively provided in order of the regions (1) to (4) in the period of the one rotation of the rotor.

Effect of the Invention

A gas compressor according to the present invention makes it possible to improve efficiency.

MODE FOR CARRYING OUT THE INVENTION

Hereinafter, a specific embodiment of a gas compressor according to the present invention will be explained in detail.

An electrical rotary vane compressor 100 (hereinafter, simply referred to as a compressor 100) as one embodiment of the gas compressor according to the present invention is used as a gas compressor in an air conditioning system mounted in an automobile, or the like including an evaporator, a gas compressor, a condenser and an expansion valve.

The air conditioning system constitutes a refrigeration cycle by circulating a refrigerant gas G (gas).

Figure 1:
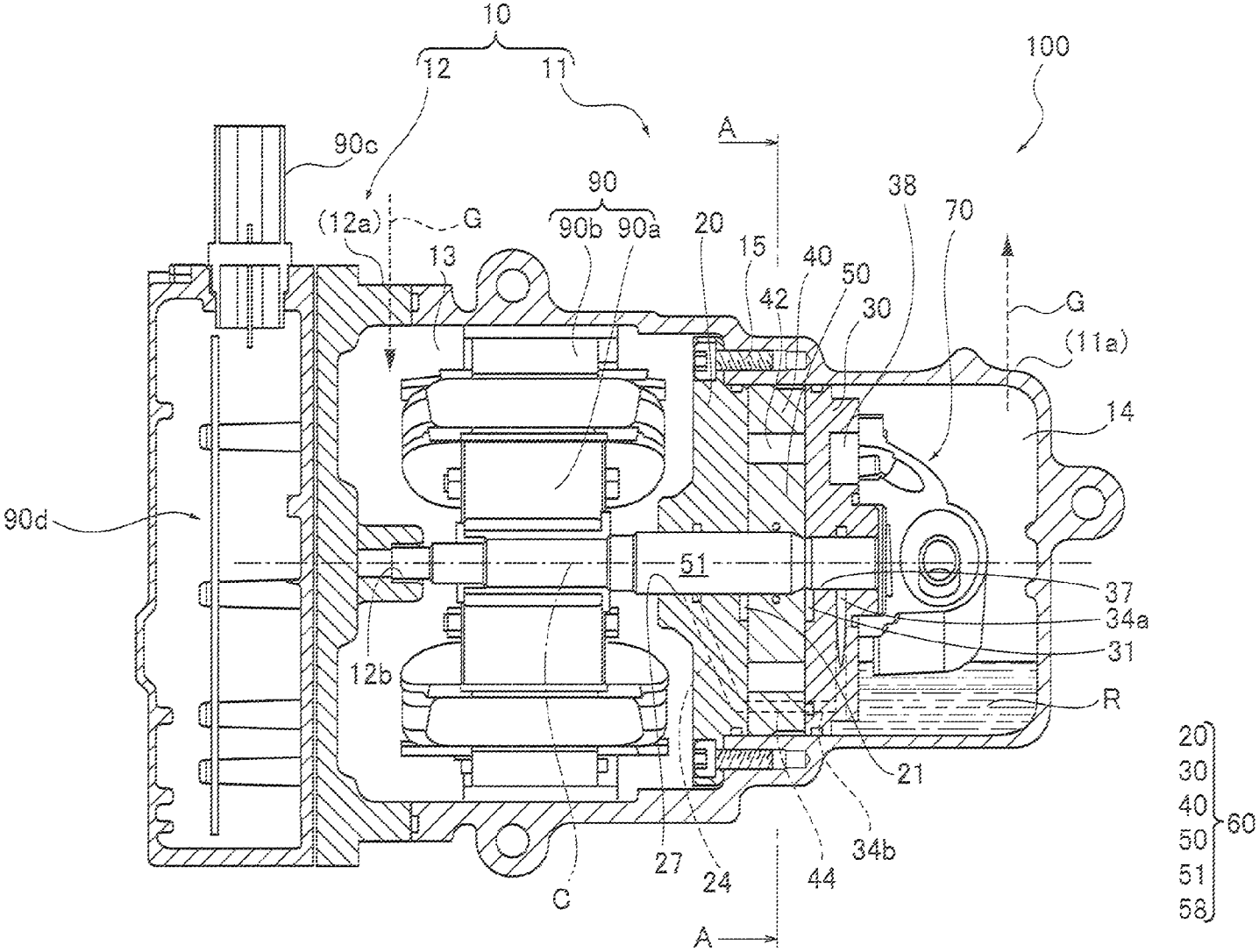
FIG. 1 is a longitudinal-sectional view of a rotary vane compressor as one embodiment according to the present invention.

The compressor 100, as shown in FIG. 1, is constituted of a motor 90 and a compressor body 60 stored in a housing 10 which is mainly constituted of a body case 11 and a front cover 12.

The body case 11 has an approximately cylindrical shape, and is formed such that one end of the cylindrical-shaped body case 11 is closed, and the other end has an opening.

The front cover 12 is formed to be lid-shaped so as to cover the opening in a state of contact with the end on the opening side of the body case 11. In this state, the front cover 12 is fastened to the body case 11 by a fastener member and unified, which forms the housing 10 having a space inside.

In the front cover 12, an intake port 12*a* is formed which introduces a low-pressure refrigerant gas G from an evaporator of the air conditioning system to the inside of the housing 10 by communicating with the inside and the outside of the housing 10.

On the other hand, in the body case 11, a discharge port 11*a* is formed which discharges a high-pressure refrigerant gas G from the inside of the housing 10 to a condenser of the air conditioning system by communicating with the inside and the outside of the housing 10.

The motor 90 provided in the body case 11 constitutes a multiphase brushless DC motor including a permanent magnet rotor 90*a* and an electric magnet stator 90*b*.

The stator 90*b* is fixed by fitting into an inner circumferential surface of the body case 11, and to the rotor 90*a*, a rotary shaft 51 is fixed.

The motor 90 rotationally drives the rotor 90*a* and the rotary shaft 51 around a shaft center C of the rotary shaft 51 by exciting an electric magnet of the stator 90*b* by electrical power supplied via a power source connector 90*c* attached to the front cover 12.

Between the power source connector 90*c* and the stator 90*b*, a structure including an inverter circuit 90*d* or the like can be adopted.

Although the compressor 100 of the present embodiment is an electrical compressor as described above, a compressor according to the present invention is not limited to an electrical compressor, but can be a mechanical compressor. If the compressor 100 of the present embodiment is a mechanical compressor, a structure can be provided in which, in place of the motor 90, the rotary shaft 51 protrudes from the front cover 12, and at an end portion of the protruded rotary shaft 51, a pulley, a gear, or the like which receives transmission of motive power from an engine or the like of a vehicle is provided.

The compressor body 60 stored with the motor 90 in the housing 10 is placed along with the motor 90 along a direction where the rotary shaft 51 extends, and is fixed to the body case 11 by a fastener member 15 such as a bolt, or the like.

Figure 2:
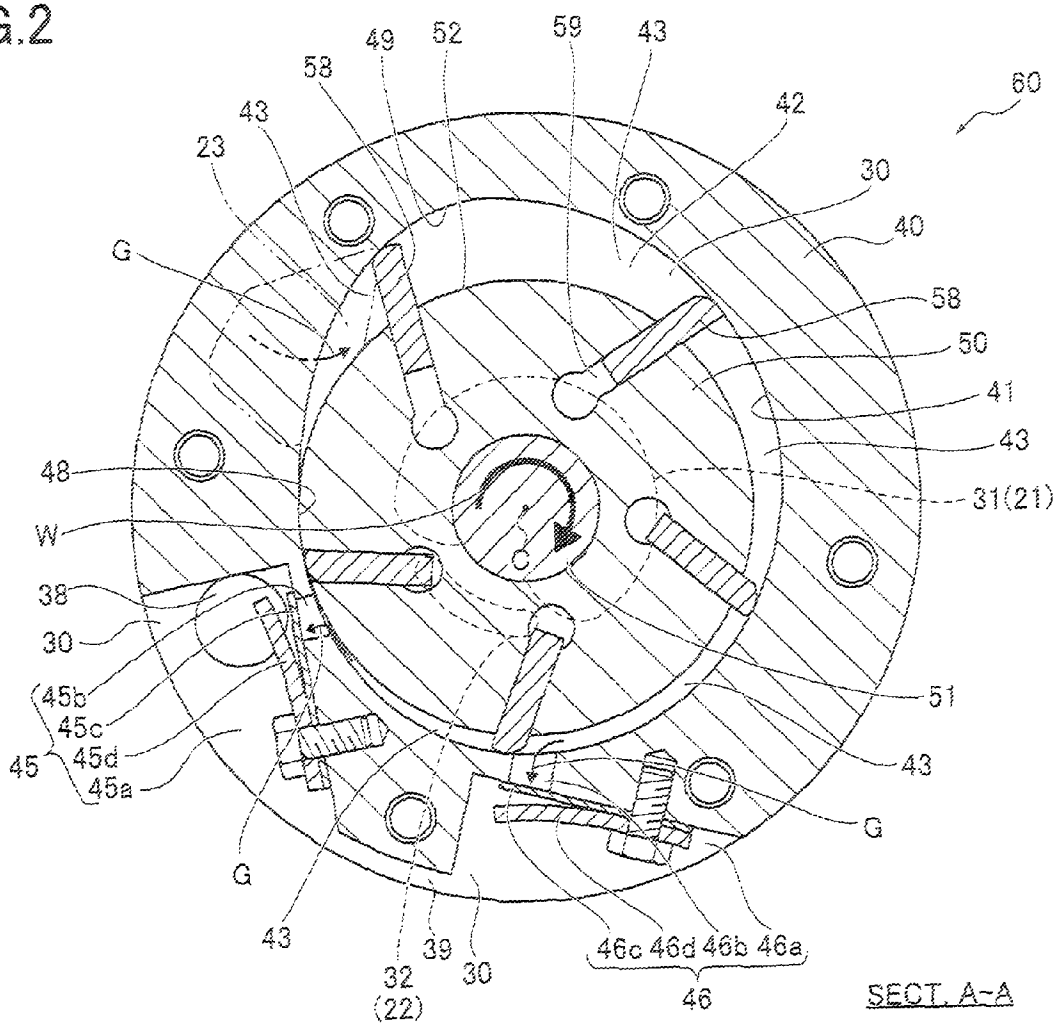
FIG. 2 is a cross-sectional view of a compressor part of the rotary vane compressor shown in FIG. 1 along line A-A.

The compressor body 60 stored in the housing 10 includes the rotary shaft 51 which is rotated freely around the shaft center C by the motor 90, a rotor 50 which has an approximately cylindrical shape and rotates integrally with the rotary shaft 51, a cylinder 40 which has an inner circumferential surface 41 having an outline shape surrounding the rotor 50 from the outside of an outer circumferential surface 52 of the rotor 50 as shown in FIG. 2, five plate-like vanes 58 which are provided to protrude freely from the outer circumferential surface 52 of the rotor 50 toward the inner circumferential surface 41 of the cylinder 40, and two side blocks (front side block 20, rear side block 30) which cover both ends of the rotor 50 and the cylinder 40.

Here, the rotary shaft 51 is supported to rotate freely by a shaft bearing 12*b* formed in the front cover 12, and each of shaft bearings 27, 37 formed in each of the side blocks 20, 30 of the compressor body 60.

Additionally, the compressor body 60 divides a space in the housing 10 into a space on the left and a space on the right with respect to the compressor body 60 in FIG. 1.

The space on the left with respect to the compressor body 60 in the divided two spaces in the housing 10 is an intake chamber 13 of a low-pressure atmosphere to which a low-pressure refrigerant gas G is introduced from the evaporator through the intake port 12*a*, and the space on the right with respect to the compressor body 60 is a discharge chamber 14 of a high-pressure atmosphere from which a high-pressure refrigerant gas G is discharged to the condenser through the discharge port 11*a*.

The motor 90 is placed in the intake chamber 13.

In the compressor body 60, a single cylinder chamber 42 is formed. The single cylinder chamber 42 has an approximately letter C shape surrounded by the inner circumferential surface 41 of the cylinder 40, the outer circumferential surface 52 of the rotor 50, and the side blocks 20, 30.

Specifically, an outline shape of a transverse section of the inner circumferential surface 41 of the cylinder 40 is set such that the inner circumferential surface 41 of the cylinder 40 and the outer circumferential surface 52 of the rotor 50 are adjacent to each other at only one portion in a range of one rotation (angle of 360 degrees) around the shaft center C of the rotary shaft 51, and the cylinder chamber 42 thus forms a single space.

In the outline shape of the transverse section of the inner circumferential surface 41 of the cylinder 40, an adjacent portion 48 which is formed as a portion at which the inner circumferential surface 41 of the cylinder 40 and the outer circumferential surface 52 of the rotor 50 are most adjacent to each other is formed at a position which is distant from equal to or more than an angle of 270 degrees (less than 360 degrees) on a downstream side along a rotational direction W (clockwise direction in FIG. 2) of the rotor 50 from a distant portion 49 which is formed as a portion at which the inner circumferential surface 41 of the cylinder 40 and the outer circumferential surface 52 of the rotor 50 are most distant from each other.

The outline shape of the transverse section of the inner circumferential surface 41 of the cylinder 40 is set to have a shape (for example, an oval shape) such that from the distant portion 49 to the adjacent portion 48 along the rotational direction W of the rotary shaft 51 and the rotor 50, a distance between the outer circumferential surface 52 of the rotor 50 and the inner circumferential surface 41 of the cylinder 40 gradually reduces, and details will be described later.

The vanes 58 are stored in vane grooves 59 formed in the rotor 50, and are protruded outward from the outer circumferential surface 52 of the rotor 50 by a back pressure by a refrigerant oil R or the refrigerant gas G supplied to the vane grooves 59.

Additionally, the vanes 58 divide the single cylinder chamber 42 into a plurality of compression chambers 43, and each compression chamber 43 is formed by two vanes 58 which are consecutively provided along the rotational direction W of the rotary shaft 51 and the rotor 50.

Therefore, in the present embodiment in which the five vanes 58 are provided at equal angular intervals of an angle of 72 degrees around the rotary shaft 51, five or six compression chambers 43 are formed.

Regarding a compression chamber 43 in which the adjacent portion 48 exists between two vanes 58, 58, one closed space is constituted by the adjacent portion 48 and one vane 58. Therefore, the compression chamber 43 in which the adjacent portion 48 exists between the two vanes 58, 58 results in two compression chambers 43, 43, and six compression chambers 43 are thus formed even in a case of the five vanes.

A capacity in a compression chamber 43 obtained by dividing the cylinder chamber 42 by the vanes 58 gradually reduces while the compression chamber 43 moves from the distant portion 49 to the adjacent portion 48 along the rotational direction W.

An intake hole 23 which is formed in the front side block 20 and communicates with the intake chamber 13 (in FIG. 2, since the front side block 20 is located on a front side of the cross section on a page, the intake hole 23 formed in the front side block 20 is illustrated by an imaginary line (two-dot chain line)) faces a portion of the cylinder chamber 42 on a most upstream side in the rotational direction W (a nearest portion on a downstream side with respect to the adjacent portion 48 along the rotational direction W).

On the other hand, a discharge hole 45*b* which communicates with a discharge chamber 45*a* of a first discharge part 45 formed in the cylinder 40 faces a portion of the cylinder chamber 42 on a most downstream side in the rotational direction W of the rotor 50 (a nearest portion on an upstream side with respect to the adjacent portion 48 along the rotational direction W), and a discharge hole 46*b* which communicates with a discharge chamber 46*a* of a second discharge part 46 formed in the cylinder 40 faces a portion of the cylinder chamber 42 on an upstream side in the rotational direction W of the rotor 50.

The outline shape of the transverse section of the inner circumferential surface 41 of the cylinder 40 is set such that only one cycle of intake of the refrigerant gas G from the intake chamber 13 to a compression chamber 43 through the intake hole 23 formed in the front side block 20, compression of the refrigerant gas Gin the compression chamber 43 and discharge of the refrigerant gas G from the compression chamber 43 to the discharge chamber 45*a* through the discharge hole 45*b* is performed in a period of one rotation of the rotor 50 per compression chamber 43.

On the most upstream side in the rotational direction W of the rotor 50, the outline shape of the transverse section of the inner circumferential surface 41 is set such that a small distance between the inner circumferential surface 41 of the cylinder 40 and the outer circumferential surface 52 of the rotor 50 rapidly becomes larger, and in an angle range including the distant portion 49, with rotation in the rotational direction W, a capacity of a compression chamber 43 increases, and the refrigerant gas G is taken in the compression chamber 43 through the intake hole 23 formed in the front side block 20, which is referred to as an intake process.

Next, toward a downstream in the rotational direction W, the outline shape of the transverse section of the inner circumferential surface 41 is set such that the distance between the inner circumferential surface 41 of the cylinder 40 and the outer circumferential surface 52 of the rotor 50 gradually becomes smaller, and therefore, in that range, with the rotation of the rotor 50, the capacity of the compression chamber 43 reduces, and the refrigerant gas G in the compression chamber 43 is compressed, which is referred to as a compression process.

Further, on the downstream side in the rotational direction W of the rotor 50, the distance between the inner circumferential surface 41 of the cylinder 40 and the outer circumferential surface 52 of the rotor 50 becomes further smaller, the compression of the refrigerant gas G is further progressed, and when the pressure of the refrigerant gas G reaches a discharge pressure, the refrigerant gas G is discharged to the discharge chambers 45*a*, 46*a* of the discharge parts 45, 46 through the later-described discharge holes 45*b*, 46*b*, respectively, which is referred to as a discharge process.

With the rotation of the rotor 50, each compression chamber 43 repeats the intake process, compression process and discharge process in this order, and therefore, a low-pressure refrigerant gas G taken from the intake chamber 13 becomes a high-pressure refrigerant gas, and it is discharged to a cyclone block 70 (oil separator) which is external to the compressor body 60.

The discharge parts 45, 46 include the discharge chambers 45*a*, 46*a*, the discharge holes 45*b*, 46*b*, discharge valves 45*c*, 46*c* and valve supports 45*d*, 46*d*, respectively. Each of the discharge chambers 45*a*, 46*a* is a space surrounded by an outer circumferential surface of the cylinder 40 and the body case 11. Each of the discharge holes 45*b*, 46*b* communicates with each of the discharge chambers 45*a*, 46*a* and a compression chamber 43. Each of the discharge valves 45*c*, 46*c* elastically deforms so as to be curved toward a side of each of the discharge chambers 45*a*, 46*a* by a differential pressure and opens each of the discharge holes 45*b*, 46*b*, when a pressure of the refrigerant gas G in the compression chamber 43 is equal to or higher than a pressure in each of the discharge chambers 45*a*, 46*a* (discharge pressure), and closes each of the discharge holes 45*a*, 46*b* by an elastic force, when the pressure of the refrigerant gas G is less than the pressure in each of the discharge chambers 45*a*, 46*a* (discharge pressure). Each of the valve supports 45*d*, 46*d* prevents each of the discharge valves 45*c*, 46*c* from being curved excessively toward the side of each of the discharge chambers 45*a*, 46*a*.

A discharge part of the two discharge parts 45, 46 which is provided on the downstream side in the rotational direction W, that is, the first discharge part 45 on a side close to the adjacent portion 48 is a primary discharge part.

Since a compression chamber 43 in which the pressure inside always reaches the discharge pressure faces the first discharge part 45 as the primary discharge part, during a period when the compression chamber 43 passes the first discharge part 45, the refrigerant gas G compressed in the compression chamber 43 always continues to be discharged.

On the other hand, a discharge part of the two discharge parts 45, 46 which is provided on an upstream side in the rotational direction W, that is, the second discharge part 46 on a side distant from the adjacent portion 48 is a secondary discharge part.

The second discharge part 46 as the secondary discharge part is provided to prevent overcompression (being compressed to a pressure which exceeds the discharge pressure) in a compression chamber 43, when a pressure in the compression chamber 43 reaches the discharge pressure at a stage before the compression chamber 43 faces the discharge part 45 on the downstream side, and only in a case where the pressure in the compression chamber 43 reaches the discharge pressure during a period when the compression chamber 43 faces the discharge part 46, the refrigerant gas G in the compression chamber 43 is discharged, and in a case where the pressure in the compression chamber 43 does not reach the discharge pressure, the refrigerant gas G in the compression chamber 43 is not discharged.

The discharge chamber 45*a* of the first discharge part 45 faces a discharge passage 38 which is formed to penetrate an outer surface (surface facing the discharge chamber 14) of the rear side block 30, and the discharge chamber 45*a* communicates with the cyclone block 70 attached to the outer surface of the rear side block 30 via the discharge passage 38.

On the other hand, the discharge chamber 46*a* of the second discharge part 46 does not directly communicate with the cyclone block 70. A cut formed in the outer circumferential surface of the cylinder 40 is a communication passage 39 which communicates with the discharge chamber 45*a* of the first discharge part 45, and via the communication passage 39, the discharge chamber 45*a* and the discharge passage 38, the discharge chamber 46*a* of the second discharge part 46 communicates with the cyclone block 70.

Therefore, the refrigerant gas G discharged to the discharge chamber 46*a* of the second discharge part 46 is discharged to the cyclone block 70 through the communication passage 39, the discharge chamber 45*a* and the discharge passage 38 in this order.

The cyclone block 70 is provided on a downstream side of a flow of the refrigerant gas G with respect to the compressor body 60, and separates a refrigerant oil R mixed in a refrigerant gas G discharged from the compressor body 60 from the refrigerant gas G.

Specifically, by spinning in a spiral manner a refrigerant gas G which is discharged from the discharge hole 45*b* of the first discharge part 45 to the discharged chamber 45*a* and discharged from the compressor body 60 through the discharge passage 38, and a refrigerant gas G which is discharged from the discharge hole 46*b* of the second discharge part 46 to the discharge chamber 46*a* and discharged from the compressor body 60 through the communication passage 39, the discharge chamber 45*a* of the first discharge part 45 and the discharge passage 38, the refrigerant oil R is centrifuged from the refrigerant gas G.

The refrigerant oil R separated from the refrigerant gas G is deposited at the bottom of the discharge chamber 14, and a high-pressure refrigerant gas G after the refrigerant oil R has been separated is discharged to the discharge chamber 14, and then discharged to a condenser through the discharge port 11*a*.

The refrigerant oil R deposited at the bottom of the discharge chamber 14 is supplied to each of the vane grooves 59 by a high-pressure atmosphere of the discharge chamber 14 through an oil passage 34*a* formed in the rear side block 30 and dredge grooves 31, 32 formed in the rear side block 30 as concave portions for supplying a back pressure, and through the oil passage 34*a*, an oil passage 34*b* formed in the rear side block 30, an oil passage 44 formed in the cylinder 40, an oil passage 24 formed in the front side block 20 and dredge grooves 21, 22 formed in the front side block 20 as concave portions for supplying a back pressure.

That is, when the vane grooves 59 which penetrate both end surfaces of the rotor 50 communicate with each of the dredge grooves 21, 31 of each of the side blocks 20, 30, or each of the dredge grooves 22, 32 of each of the side blocks 20, 30 by the rotation of the rotor 50, from the communicated dredge grooves 21, 31 or dredge grooves 22, 32, the refrigerant oil R is supplied to the vane grooves 59, and a pressure of the supplied refrigerant oil R is a back pressure which protrudes the vanes 58 outward.

Here, a passage through which the refrigerant oil R passes between the oil passage 34*a* and the dredge groove 31 of the rear side block 30 is an extremely narrow gap between the shaft bearing 37 of the rear side block 30 and an outer circumferential surface of the rotary shaft 51 supported by the shaft bearing 37.

Although, in the oil passage 34*a* the refrigerant oil R has the same high pressure as the high-pressure atmosphere in the discharge chamber 14, owing to an influence of a pressure loss while passing through the narrow gap, when the refrigerant oil R reaches the dredge groove 31, the pressure of the refrigerant oil R becomes a medium pressure which is lower than a pressure in the discharge chamber 14.

Here, the medium pressure is a pressure which is higher than a low pressure which is a pressure of the refrigerant gas G in the intake chamber 13 and lower than a high pressure which is a pressure of the refrigerant gas G in the discharge chamber 14.

Likewise, a passage through which the refrigerant oil R passes between the oil passage 24 and the dredge groove 21 of the front side block 20 is an extremely narrow gap between the shaft bearing 27 of the front side block 20 and the outer circumferential surface of the rotary shaft 51 supported by the shaft bearing 27.

Although the refrigerant oil R has the same high pressure as the high-pressure atmosphere in the discharge chamber 14 in the oil passage 24, owing to an influence of a pressure loss while passing through the narrow gap, when the refrigerant oil R reaches the dredge groove 21, the pressure of the refrigerant oil R becomes a medium pressure which is lower than the pressure in the discharge chamber 14.

Therefore, the back pressure which is supplied from the dredge grooves 21, 31 to the vane grooves 59 and protrudes the vanes 58 toward the inner circumferential surface 41 of the cylinder 40 is the medium pressure which is the refrigerant oil R.

On the other hand, since the dredge grooves 22, 32 communicate with the oil passages 24, 34 without a pressure loss, a high-pressure refrigerant oil R which has the same high pressure as the pressure in the discharge chamber 14 is supplied to the dredge grooves 22, 32. Accordingly, at the end of the compression process in which the vane grooves 59 communicate with the dredge grooves 22, 32, chattering of the vanes 58 is prevented by supplying a high back pressure to the vanes 58.

The refrigerant oil R leaks out from gaps between the vanes 58 and the vane grooves 59, gaps between the rotor 50 and the side blocks 20, 30, or the like, and exerts functions of lubrication and refrigeration at contact portions between the rotor 50 and the side blocks 20, 30, contact portions between the vanes 58 and the cylinder 40, or the side blocks 20, 30, or the like, and a part of the refrigerant oil R is mixed with the refrigerant gas R in a compression chamber 43, and therefore, separation of the refrigerant oil R is performed by the cyclone block 70.

In the compressor 100 of the present embodiment structured as above, the first discharge part 45 and the second discharge part 46 are communicated by the communication passage 39 on an upstream side with respect to the cyclone block 70, and therefore, the refrigerant gas G discharged from the second discharge part 46 flows into the cyclone block 70 through the discharge passage 38 which is a passage to which the refrigerant gas G discharged from the first discharge part 45 is discharged.

Thus, the discharge passage 38 by which the refrigerant gas G discharged from the first discharge part 45 is discharged to the outside of the compressor body 60, and a discharge passage by which the refrigerant gas G discharged from the second discharge part 46 is discharged to the outside of the compressor body 60 do not need to be formed independently on an outer surface of the compressor body 60 and in the cyclone block 70, respectively, and therefore, it is possible to simplify structures of the compressor body 60 and the cyclone block 70.

In the compressor 100 of the present embodiment, the refrigerant gas G discharged to the second discharge part 46 is discharged by the first discharge part 45, and discharged to the outside of the compressor body 60 through the discharge passage 38 which faces the first discharge part 45; however, conversely, while a discharge passage which penetrates an outer surface of the rear side block 30 is formed to face the discharge chamber **46*a* of the second discharge part 46, the discharge passage 38 formed to face the discharge chamber 45*a* of the first discharge part 45 in the above-described embodiment is removed, and the refrigerant gas G discharged to the discharge chamber 45*a* of the first discharge part 45 can be discharged to the outside of the compressor body 60 through the communication passage 39, the discharge chamber 46*a* of the second discharge part 46**, and the discharge passage.

Additionally, since the compressor 100 of the above-described embodiment includes the second discharge part 46 on an upstream side with respect to the first discharge part 45, even in a case where the pressure in the compression chamber 43 reaches the discharge pressure at the stage before the compression chamber 43 faces the first discharge part 45, when the compression chamber 43 faces the second discharge part 46 located on the upstream side with respect to the first discharge part 45, the refrigerant gas G in the compression chamber 43 is discharged from the compression chamber 43 through the second discharge part 46, and therefore, it is possible to prevent overcompression (being compressed to a pressure which exceeds the discharge pressure) in the compression chamber 43.

Next, the outline shape of the transverse section of the cylinder 40 of the compressor 100 of the present embodiment will be explained in detail with reference to FIGS. 3 and 4.

Figure 3:
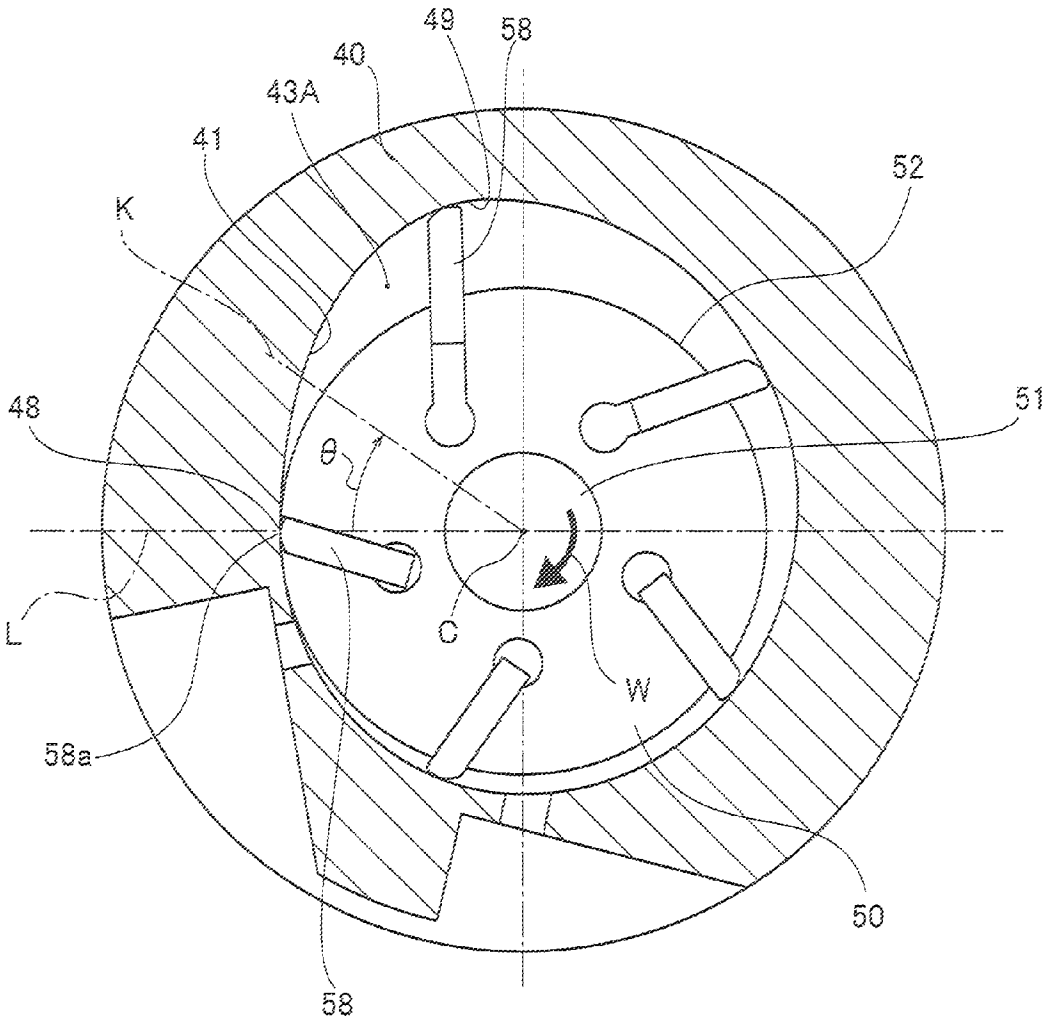
FIG. 3 is a schematic view equivalent to FIG. 2 which explains a rotation angle from a reference position (reference line L) where an end of a vane contacts an adjacent portion of a cylinder.

As shown in FIG. 3, the outline shape of the transverse section of the inner circumferential surface 41 of the cylinder 40 is set corresponding to an angle θ along the rotational direction W of the rotor 50 from a reference line L which connects the adjacent portion 48 and the shaft center C.

Specifically, a specific compression chamber 43A of the plurality of compression chambers 43 is significant. A straight line K is a line obtained by connecting a contact point at which a vane 58 which is located on an upstream side (rear side) in the rotational direction W with respect to the specific compression chamber 43A contacts the inner circumferential surface 41 of the cylinder 40 and the shaft center C. A capacity of the compression chamber 43A per angle θ (corresponding to a rotation angle of the rotor 50) between the straight line K and the reference line L has a correspondence relationship as shown in FIG. 4.

Figure 4:
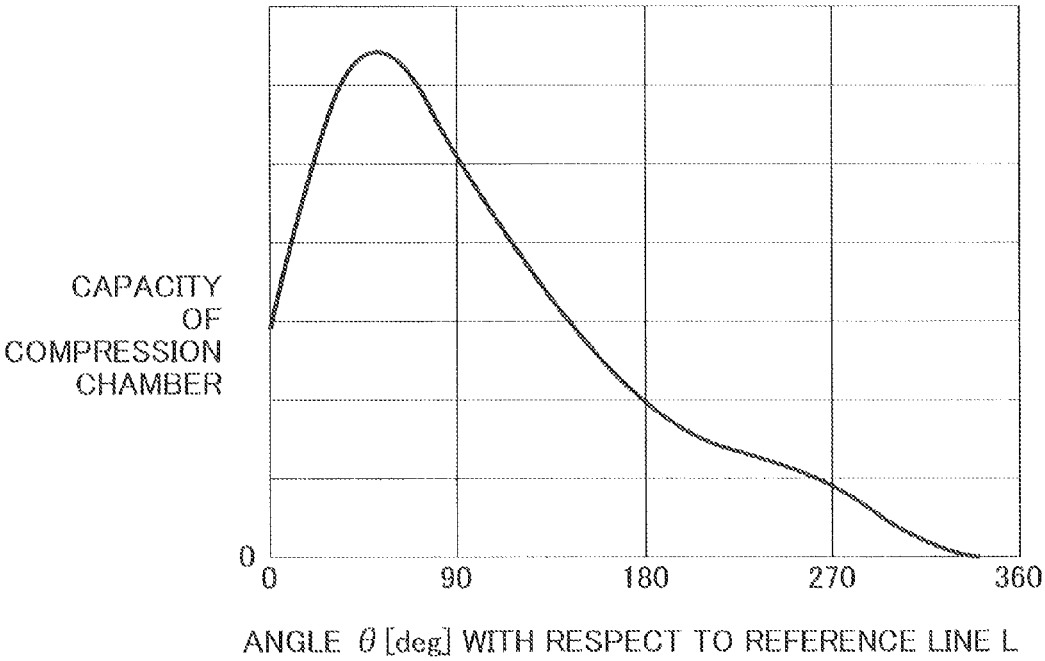
FIG. 4 is a graph showing a capacity of a compression chamber per rotation angle of a rotor.

That is, the outline shape of the transverse section of the inner circumferential surface 41 of the cylinder 40 is formed such that in a period of one rotation of the rotor 50 (a position of a starting point of one rotation (angle θ=0 degrees) taken as a reference is a position (position corresponding to a state shown in FIG. 3) where a head end **58*a* on a side of the cylinder 40 of a vane 58 on the upstream side in the rotational direction W with respect to the compression chamber 43A contacts the adjacent portion 48), as shown in FIG. 4**, the following regions (1) to (4) are consecutively provided in order of the regions (1) to (4). Regions (1) to (4) are as follows:

(1) a region in which a capacity of the compression chamber 43A rapidly increases;

(2) a region in which the capacity of the compression chamber 43A rapidly reduces;

(3) a region in which a capacity reduction rate of the compression chamber 43A (a ratio (rate) of a reduction of capacity to an angular variation AO) is smaller than a capacity reduction rate of the region (2); and (4) a region in which the capacity reduction rate of the compression chamber 43A is larger than a capacity reduction rate of the region (3).

The region (1) is specifically, for example, a region corresponding to a range of the angle θ=0 to 60 degrees, the region (2) is specifically, for example, a region corresponding to a range of the angle θ=60 to 150 degrees, the region (3) is specifically, for example, a region corresponding to a range of the angle θ=150 to 250 degrees, and the region (4) is specifically, for example, a region corresponding to a range of the angle θ=250 to 360 degrees.

In the compressor 100 of the present embodiment in which the outline shape of the transverse section of the inner circumferential surface 41 of the cylinder 40 is thus formed, the compression process and the discharge process (processes corresponding to the regions (2) to (4)) are formed so as to be lengthened with respect to the intake process (process corresponding to the region (1)), and additionally, the capacity reduction rate is reduced in the late compression process, and therefore, it is possible to prevent an occurrence of overcompression due to a rapid compression, and reduce a discharge pressure drop, because it is possible to slow a discharge flow velocity in the discharge process.

Therefore, it is possible to prevent motive power from increasing, and improve efficiency (Coefficient of Performance, or COP: refrigerated air conditioning performance/power).

Figure 5:
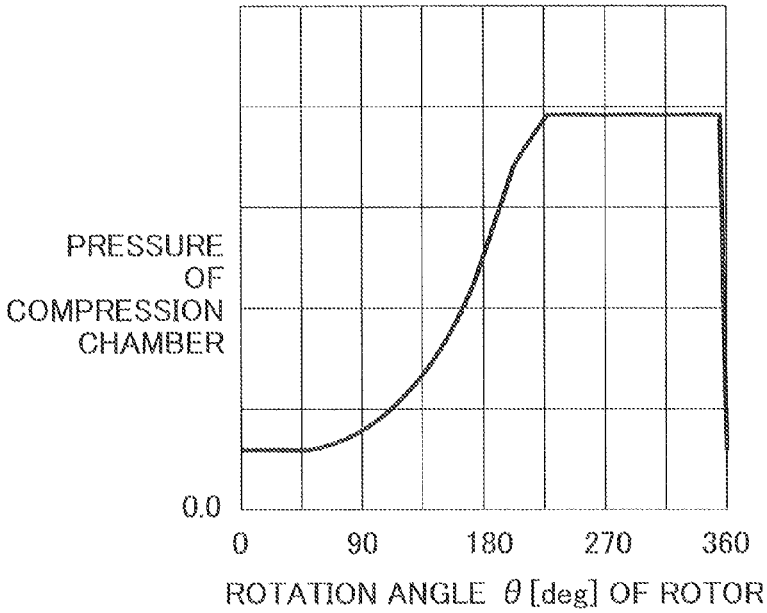
FIG. 5 is a graph showing a pressure of the compression chamber per rotation angle of the rotor.

Additionally, the outline shape of the transverse section of the inner circumferential surface 41 of the cylinder 40 is formed such that in the period of the one rotation of the rotor 50, the regions (1) to (4) are consecutively provided in order of the regions (1) to (4), and therefore, it is possible to adjust a rate of an increase of a pressure in the compression chamber 43A (a ratio (rate) of an increase of a pressure to the angular variation AO) to be an approximately constant straight line as shown in FIG. 5.

Furthermore, it is possible to lengthen a period in which the rate of the increase of the pressure in the compression chamber 43A is constant (a period in which a pressure increase rate is straight-lined), and reduce the rate of the increase of the pressure (moderate the increase of the pressure).

Therefore, it is possible to prevent the pressure in the compression chamber 43A from changing rapidly, and even at the end of the compression process, it is possible to appropriately prevent overcompression from occurring in the compression chamber 43A.

Figure 6:
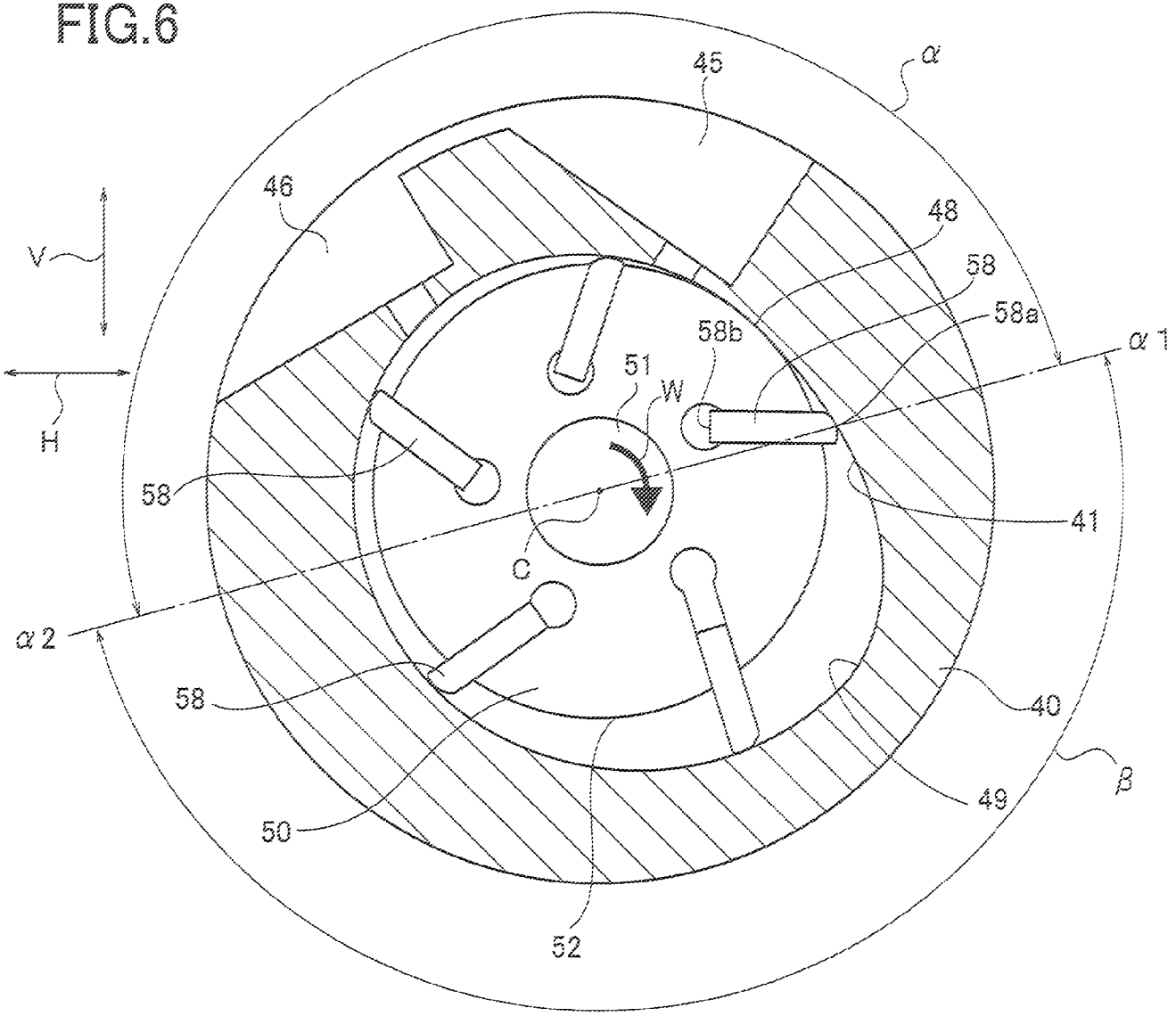
FIG. 6 is a schematic view equivalent to FIG. 3 showing an embodiment where an adjacent portion is placed in a rotation angle range which is located relatively above in a rotation angle range which is interposed between two rotation angle positions at which a vane is in a horizontal posture.
Figure 7:
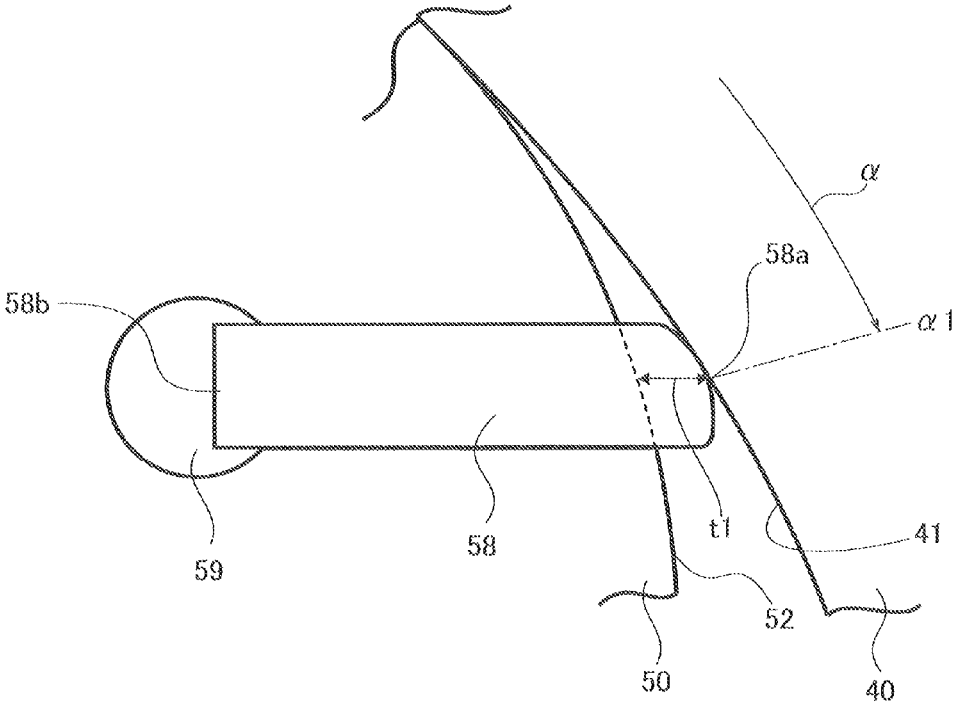
FIG. 7 is a detailed view showing the vane in the compressor in FIG. 6 which is in the horizontal posture at a rotation angle position which is located above.
Figure 8:
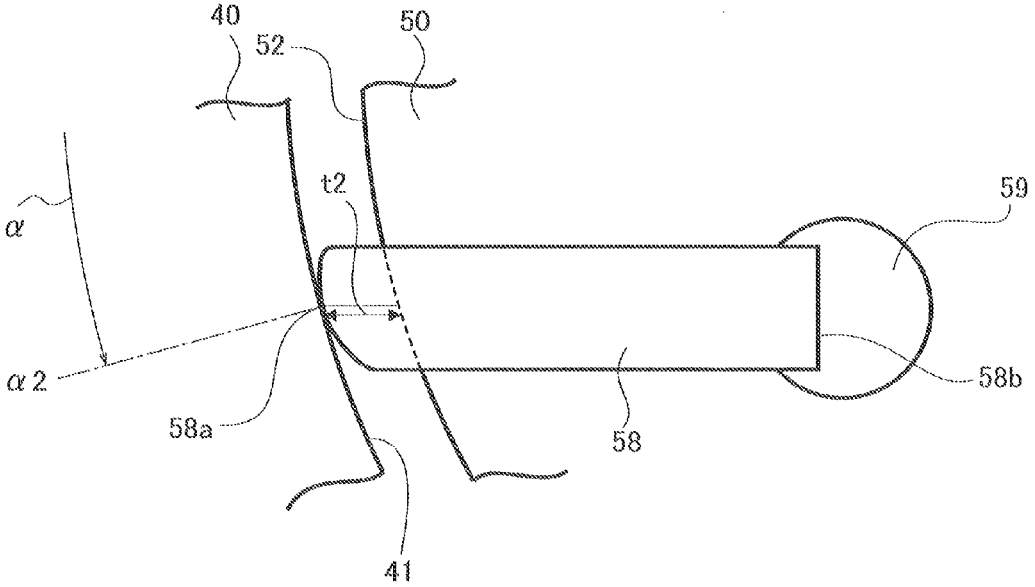
FIG. 8 is a detailed view showing the vane in the compressor in FIG. 6 which is in the horizontal posture at a rotation angle position which is located below.

In the compressor 100 of the above-described embodiment, as shown in FIGS. 6, 7 and 8, it is preferable that the distant portion 49 be placed in a rotation angle range β which is located relatively below (FIG. 6) in a rotation angle range which is interposed between two rotation angle positions α1, α2 (FIGS. 7, 8) at which a posture of a vane 58 is in a horizontal state in the period of the one rotation of the rotor 50.

A posture of a vane 58 being in a horizontal state means that a position corresponding to the height along a vertical direction V of a head end 58*a* on a side of the cylinder 40 (an end portion on the side of the cylinder 40) of the vane 58 and a position corresponding to the height along the vertical direction V of a tail end 58*b* on a side of the rotor 50 (an end portion on the side of the rotor 50) of the vane 58 are in a matching state, and in other words, means a posture where the vane 58 extends along a horizontal direction H.

The distant portion 49 is a portion at which the distance between the inner circumferential surface 41 of the cylinder 40 and the outer circumferential surface 52 of the rotor 50 is most distant, and therefore, at the distant portion 49, a protrusion amount of a head end 58*a* on the side of the cylinder 40 of a vane 58 from the outer circumferential surface 52 of the rotor 50 is largest.

The outline shape of the inner circumferential surface 41 of the cylinder 40 is a smoothly continuous shape, and therefore, protrusion amounts of head ends 58*a* of vanes 58 from the outer circumferential surface 52 of the rotor 50 are larger, as the head ends 58*a* are closer to the distant portion 49.

Accordingly, in the rotation angle range β corresponding to a side where the distant portion 49 is placed in the rotation angle range which is interposed between the two rotation angle positions α1, α2, the protrusion amounts of the head ends 58*a* of the vanes 58 are relatively larger than in a rotation angle range a (which is located relatively above) corresponding to a side where the distant portion 49 is not placed.

Here, when the compressor 100 is stopped (the rotor 50 does not rotate), a centrifugal force and the back force of the refrigerant oil R do not act on the vanes 58, and therefore, the vanes 58 which are placed in the rotation angle range α sink in the vane grooves 59 due to their own weight, and the head ends 58*a* of the vanes 58 are in a state of being distant from the inner circumferential surface 41 of the cylinder 40, which makes a state of an undivided compression chamber 43.

When the compressor 100 is switched from a stop state to an operating state (a state where the rotor 50 rotates), the centrifugal force and the back force act on the vanes 59 sunk in the vane grooves 59, and the vanes 58 protrude from the outer inner circumferential surface 52 of the rotor 50.

In the compressor 100 of the present embodiment, the distant portion 49 is in the rotation angle range β in which the protrusion amounts of the vanes 58 are relatively larger and which is located below, and the vanes 58 in the rotation angle range β do not sink in vane grooves 59, and therefore, it is possible to prevent or suppress a time required for the head ends 58*a* of the vanes 58 to contact the inner circumferential surface 41 of the cylinder 48 and form divided compression chambers 43 from becoming relatively longer.

The time required to form the divided compression chambers 43 is relatively short, and therefore, it is possible to realize the compression process earlier, and improve a starting performance of the compressor 100.

In the above-described compressor 100, it is particularly preferable that the adjacent portion 48 be placed in the rotation angle range α.

The adjacent portion 48 is a portion at which the distance between the inner circumferential surface 41 of the cylinder 40 and the outer circumferential surface 52 of the rotor 50 is most adjacent, and therefore, at the adjacent portion 48, a protrusion amount of a head end 58*a* on the side of the cylinder 40 of a vane 58 from the outer circumferential surface 52 of the rotor 50 is smallest (the protrusion amount is approximately zero).

Accordingly, when the compressor 100 is switched from the stop state to the operating state (the state where the rotor 50 rotates) and the vanes 58 protrude from the outer circumferential surface 52 of the rotor 50, protrusion amounts of the vanes 58 in the vicinity of the adjacent portion 48 including the adjacent portion 48 are smaller than protrusion amounts of the vanes 58 in a range other than the vicinity of the adjacent portion 48 including the adjacent portion 48, and therefore, it is possible to further shorten a time required for the head ends 58*a* of the vanes 58 in the rotation angle range α to contact the inner circumferential surface 41 of the cylinder 48 and to form divided compression chambers 43.

The time required to form the divided compression chambers 43 is relatively short, and therefore, it is possible to realize the compression process earlier, and further improve the starting performance of the compressor 100.

In the compressor 100 of the above-described embodiment, it is particularly preferable that, in the rotation angle range α which is located relatively above, a protrusion length t2 of a vane 58 at the rotation angle position α2 corresponding to an end on the upstream side in the rotational direction W of the rotor 50 with respect to the adjacent portion 48 and a protrusion length t1 of a vane 58 at the rotation angle position α1 corresponding to an end on the downstream side in the rotational direction W of the rotor 50 with respect to the adjacent portion 48 be set to be equal.

In the compressor 100 which is thus set, the protrusion amounts t1, t2 at the rotation angle positions α1, α2 corresponding to both ends in the rotation angle range α are equal, and therefore, even if a vane 58 is either of the vanes 58 which is stopped on the upstream side, or on the downstream side with respect to the adjacent portion 48, it is possible to suppress a protrusion amount t of the vane 58 sunk in a vane groove 59 to the protrusion amount t1(=t2) at the maximum.

Figure 9:
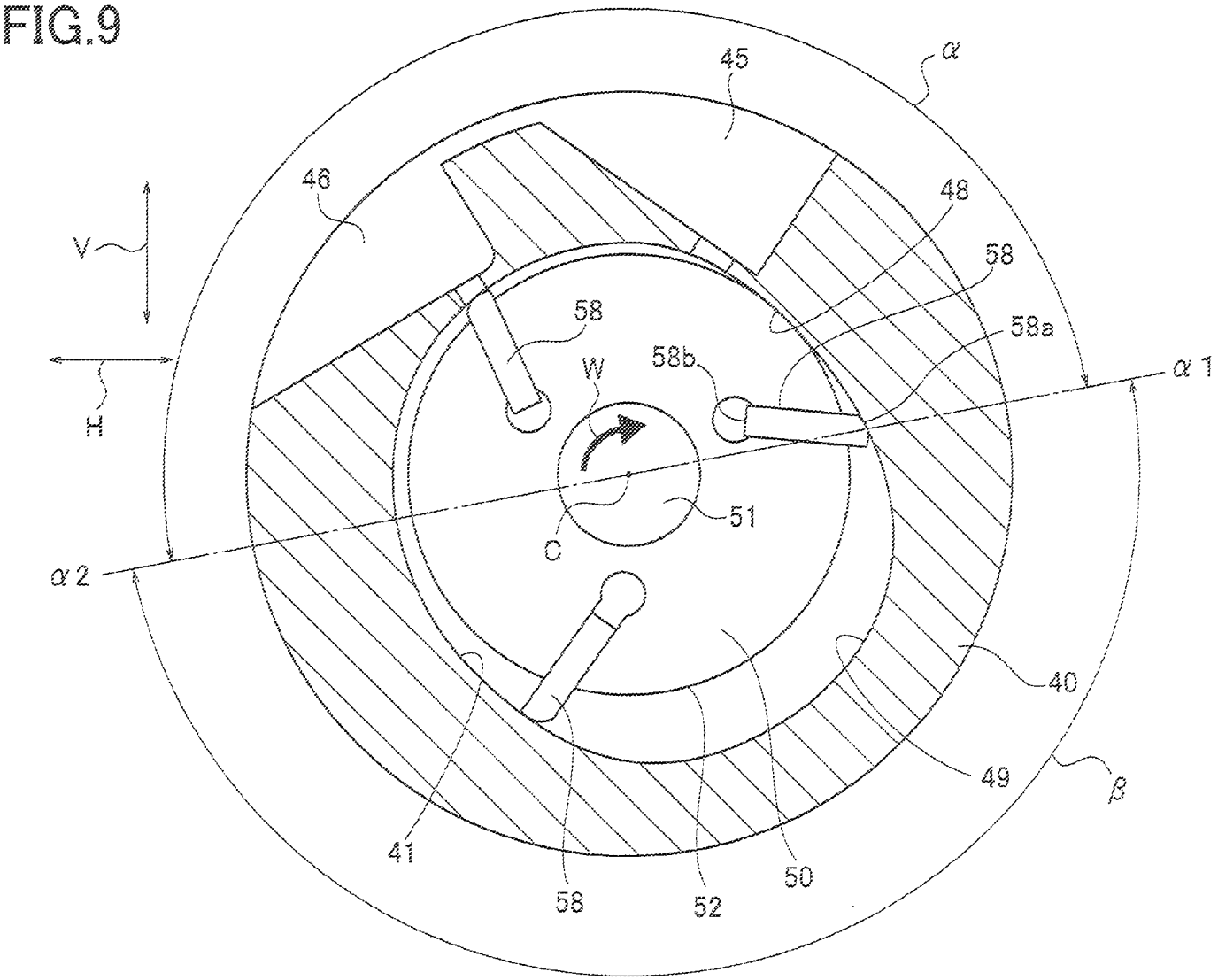
FIG. 9 is a schematic view equivalent to FIG. 6 showing an embodiment of a compressor having three vanes.

The compressor 100 of the above-described embodiment has five vanes 58; however, a gas compressor according to the present invention is not limited thereto. The number of vanes 58 may be three as shown in FIG. 9, or may be appropriately selectable from two, four, six, or the like. Also by a gas compressor to which the thus selected vanes are applied, it is possible to obtain a function and an effect similar to the compressor 100 of the above-described embodiment.

DESCRIPTION OF REFERENCE NUMERALS

10 housing
40 cylinder
41 inner circumferential surface
43, 43A compression chamber(s)
45 first discharge part (discharge part)
46 second discharge part
48 adjacent portion
49 distant portion
50 rotor
51 rotary shaft
58 vane(s)
60 compressor body
100 electrical rotary vane compressor (gas compressor)
C shaft center
G refrigerant gas (gas)
W rotational direction

The invention claimed is:

1. A gas compressor, comprising:

a compressor body; and a housing which covers the compressor body, the compressor body, including:

a rotor which has an approximately cylindrical shape, and rotates around a shaft;

a cylinder which has an inner circumferential surface having an outline shape surrounding the rotor from an outside of an outer circumferential surface of the rotor, and in which a first discharge part and a second discharge part are formed;

a plurality of plate-like vanes which receive a back pressure from vane grooves formed in the rotor and freely protrude outward from the rotor; and two side blocks, a first of the two side blocks being provided on a first end surface side of the rotor and the cylinder and a second of the two side blocks being provided on a second end surface side of the rotor and the cylinder, wherein the compressor body is formed such that a plurality of compression chambers divided by the rotor, the cylinder, the side blocks and the vanes are formed inside, and each of the plurality of compression chambers performs only one cycle of intake, compression and discharge of gas through the first discharge part in a period of one rotation of the rotor, and an outline shape of a cross section of the inner circumferential surface of the cylinder is formed such that in the period of the one rotation of the rotor, regions (1) to (4) are consecutively provided in order of the regions (1) to (4) as follows:

(1) a region in which a capacity of one of the compression chambers increases, (2) a region in which the capacity of the one compression chamber reduces, (3) a region in which a capacity reduction rate of the one compression chamber becomes smaller than a capacity reduction rate of the region (2), and (4) a region in which the capacity reduction rate of the one compression chamber becomes larger than a capacity reduction rate of the region (3);

wherein the second discharge part is configured to discharge gas in the one compression chamber in a state in which a pressure of the gas in the one compression chamber reaches a discharge pressure at a stage before the one compression chamber faces the first discharge part by rotation of the rotor; and wherein a communication passage connects the second discharge part to the first discharge part such that the gas discharged through the second discharge part must flow through the communication passage to join with gas discharged through the first discharge part and then flow to a discharge passage to an outside of the compressor body.

2. The gas compressor according to claim 1, wherein, in a rotation angle range which is located relatively above in a rotation angle range which is interposed between two rotation angle positions where a posture of one of the vanes is in a horizontal state during the period of the one rotation of the rotor, an adjacent portion at which the inner circumferential surface of the cylinder and the outer circumferential surface of the rotor are most adjacent to each other in the inner circumferential surface of the cylinder is positioned.

3. The gas compressor according to claim 2, wherein, in the rotation angle range which is located relatively above, a protrusion length of the one vane at the rotation angle position corresponding to an end on an upstream side in a rotational direction of the rotor with respect to the adjacent portion and a protrusion length of the one vane at the rotation angle position corresponding to an end on a downstream side in the rotational direction of the rotor with respect to the adjacent portion are set to be equal.

4. The gas compressor according to claim 1, wherein, in a rotation angle range which is located relatively below in a rotation angle range which is interposed between two rotation angle positions where a posture of one of the vanes is in a horizontal state during the period of the one rotation of the rotor, a distant portion at which the inner circumferential surface of the cylinder and the outer circumferential surface of the rotor are most distant from each other in the inner circumferential surface of the cylinder is positioned.

5. The gas compressor according to claim 1, wherein each of the first discharge part and the second discharge part comprises a discharge chamber which is a space surrounded by an outer circumferential surface of the cylinder and the housing.

6. The gas compressor according to claim 5, wherein each of the first discharge part and the second discharge part comprises a discharge hole which communicates with the corresponding discharge chamber.

7. The gas compressor according to claim 6, wherein each of the first discharge part and the second discharge part comprises a discharge valve.

8. The gas compressor according to claim 7, wherein the discharge valve is configured to open the corresponding discharge hole in state in which the pressure of the gas in a corresponding one of the compression chambers is equal to or higher than the corresponding discharge pressure, and is configured to close the corresponding discharge hole by an elastic force, in a state in which the pressure of the gas in the corresponding one of the compression chambers is less than the corresponding discharge pressure.

9. The gas compressor according to claim 8, wherein the discharge valve is configured to elastically deform so as to be curved toward the side of the corresponding discharge chamber by a differential pressure.

10. The gas compressor according to claim 7, wherein the discharge valve is configured to elastically deform so as to be curved toward a side of the corresponding discharge chamber.

11. The gas compressor according to claim 1, each of the vanes is disposed at an oblique angle with respect to each of the other vanes.

12. A gas compressor, comprising:

a compressor body; and a housing which covers the compressor body, the compressor body, including:

a rotor which has an approximately cylindrical shape, and rotates around a shaft;

a cylinder which has an inner circumferential surface having an outline shape surrounding the rotor from an outside of an outer circumferential surface of the rotor, and in which a first discharge part and a second discharge part are formed;

a plurality of plate-like vanes which receive a back pressure from vane grooves formed in the rotor and freely protrude outward from the rotor; and two side blocks, a first of the two side blocks being provided on a first end surface side of the rotor and the cylinder and a second of the two side blocks being provided on a second end surface side of the rotor and the cylinder, wherein the compressor body is formed such that a plurality of compression chambers divided by the rotor, the cylinder, the side blocks and the vanes are formed inside, and each of the plurality of compression chambers performs only one cycle of intake, compression and discharge of gas through the first discharge part in a period of one rotation of the rotor, and an outline shape of a cross section of the inner circumferential surface of the cylinder is formed such that in the period of the one rotation of the rotor, regions (1) to (4) are consecutively provided in order of the regions (1) to (4) as follows:

(1) a region in which a capacity of one of the compression chambers increases, (2) a region in which the capacity of the one compression chamber reduces, (3) a region in which a capacity reduction rate of the one compression chamber becomes smaller than a capacity reduction rate of the region (2), and (4) a region in which the capacity reduction rate of the one compression chamber becomes larger than a capacity reduction rate of the region (3);

wherein the second discharge part is configured to discharge gas in the one compression chamber in a state in which a pressure of the gas in the one compression chamber reaches a discharge pressure at a stage before the one compression chamber faces the first discharge part by rotation of the rotor;

wherein, in a rotation angle range which is located relatively below in a rotation angle range which is interposed between two rotation angle positions where a posture of one of the vanes is in a horizontal state during the period of the one rotation of the rotor, a distant portion at which the inner circumferential surface of the cylinder and the outer circumferential surface of the rotor are most distant from each other in the inner circumferential surface of the cylinder is positioned; and wherein one of the plurality of vanes, which is located above a center of the rotor, is configured to sink in one of the vane grooves due to the weight of the one of the plurality of vanes, which is located above the center of the rotor, in a state in which the compressor is stopped.

13. The gas compressor according to claim 12, wherein, in a rotation angle range which is located relatively above in the rotation angle range which is interposed between the two rotation angle positions where the posture of the one vane is in the horizontal state during the period of the one rotation of the rotor, an adjacent portion at which the inner circumferential surface of the cylinder and the outer circumferential surface of the rotor are most adjacent to each other in the inner circumferential surface of the cylinder is positioned.

14. The gas compressor according to claim 13, wherein, in the rotation angle range which is located relatively above, a protrusion length of the one vane at the rotation angle position corresponding to an end on an upstream side in a rotational direction of the rotor with respect to the adjacent portion and a protrusion length of the one vane at the rotation angle position corresponding to an end on a downstream side in the rotational direction of the rotor with respect to the adjacent portion are set to be equal.

* * * * *